US010314393B2

(12) United States Patent
Abeygunawardana et al.

(10) Patent No.: US 10,314,393 B2
(45) Date of Patent: Jun. 11, 2019

(54) REFRIGERATOR APPLIANCE AND VARIABLE SHELF ASSEMBLY

(71) Applicant: Haier US Appliance Solutions, Inc., Wilmington, DE (US)

(72) Inventors: Danister Abeygunawardana, Louisville, KY (US); Bagawathkumar Chellappan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 49 days.

(21) Appl. No.: 15/451,528

(22) Filed: Mar. 7, 2017

(65) Prior Publication Data

US 2018/0259245 A1 Sep. 13, 2018

(51) Int. Cl.

| | |
|---|---|
| ***F25D 25/02*** | (2006.01) |
| ***A47B 57/06*** | (2006.01) |
| ***A47B 57/42*** | (2006.01) |
| ***F25D 25/04*** | (2006.01) |

(52) U.S. Cl.

CPC ..... *A47B 57/06* (2013.01); *A47B 57/42* (2013.01); *F25D 25/04* (2013.01)

(58) Field of Classification Search

CPC ..... A47B 57/06; A47B 57/42; F25D 25/02; F25D 25/04; F25D 2325/022; Y10T 74/18752

See application file for complete search history.

(56) References Cited

U.S. PATENT DOCUMENTS

| | | | | | |
|---|---|---|---|---|---|
| 979,161 | A * | 12/1910 | Hargie | E21B 7/021 | 173/145 |
| 2,274,670 | A * | 3/1942 | Curtis | E21B 19/081 | 173/112 |
| 2,841,459 | A | 7/1958 | Sharpe | | |
| 2,978,113 | A * | 4/1961 | Anderson | A47B 51/00 | 108/141 |
| 3,982,801 | A * | 9/1976 | Heidorn | A47B 57/06 | 312/306 |
| 5,544,970 | A * | 8/1996 | Studer | F16D 1/0847 | 403/235 |
| 5,913,584 | A * | 6/1999 | Swindell | A47B 57/06 | 108/108 |

(Continued)

FOREIGN PATENT DOCUMENTS

| | | |
|---|---|---|
| EP | 2394117 A2 | 12/2011 |
| KR | 101573533 B1 | 12/2015 |

*Primary Examiner* — Matthew W Ing

(74) *Attorney, Agent, or Firm* — Dority & Manning, P.A.

(57) ABSTRACT

A refrigerator appliance and variable shelf assembly are generally provided herein. The variable shelf assembly may be mounted within the refrigerator appliance and include a stationary support screw extending along a movement axis, a mated screw, a shelving bracket, and a bi-directional ratchet gear. The mated screw may include an interior surface and an exterior surface. The interior surface may be rototranslatably mounted on the stationary support screw to rotate about the movement axis during translation therealong. The mated screw may be coaxial with the stationary support screw. The shelving bracket may be coupled to the mated screw. The shelving bracket may be rotationally fixed to translate along the movement axis. The bi-directional ratchet gear may be operably coupled to the mated screw to motivate rototranslation of the mated screw.

20 Claims, 11 Drawing Sheets

(56) References Cited

U.S. PATENT DOCUMENTS

| | | | | |
|---|---|---|---|---|
| 6,065,821 | A * | 5/2000 | Anderson | A47B 57/06 108/108 |
| 6,161,444 | A * | 12/2000 | Stenstrom | F16H 25/18 74/10.41 |
| 8,172,347 | B2 * | 5/2012 | Lim | F25D 25/02 108/106 |
| 8,529,001 | B2 | 9/2013 | Calvillo et al. | |
| 2008/0246382 | A1 * | 10/2008 | Kang | A47B 57/06 312/408 |

* cited by examiner

REFRIGERATOR APPLIANCE AND VARIABLE SHELF ASSEMBLY

FIELD OF THE INVENTION

The present subject matter relates generally to domestic appliances, and more particularly to a variable shelf assembly to adjust the height of a shelf in a refrigerator appliance.

BACKGROUND OF THE INVENTION

Domestic appliances, such as refrigerator appliances, generally include a cabinet that defines an internal chamber. In the case of refrigerator appliances, a chilled chamber may be defined for receipt of food articles for storage. Refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

Some existing refrigerator appliances include one or more shelves for holding or supporting food items within the chilled chamber. The height or position of the shelf or shelves may be changed according to the needs of a user. For instance, a shelf may be removably supported on a bracket that is permanently fixed to the refrigerator. Multiple predetermined mounting heights may be defined on the bracket by slots that receive the shelf. In order to change the height of the shelf, the shelf must be removed from the bracket. Generally, this requires a user to pivot and/or lift the shelf relative to the bracket. Moreover, the shelf must be at least partially removed from the chilled chamber.

The steps required for adjusting the height of such existing systems can be undesirably complicated. For instance, any food items held or supported by the shelf must generally be removed before the shelf may be adjusted. If the food items are not first removed, a user risks spilling or dropping the items while the shelf is unsupported by the bracket. Even if all the food items are removed, properly aligning the shelf to the bracket may be difficult for some users. Furthermore, the shelf will have only a limited number of predetermined heights, as determined by the bracket. This, in turn, limits a user's options for configuring the shelf height, as well as the overall useable space within the chilled chamber.

Accordingly, an appliance with features for easily and reliably adjusting a shelf height within the appliance would be useful. In particular, a refrigerator appliance with features for easily varying the height of a shelf while mounted within a refrigerator appliance would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a refrigerator appliance is provided. The refrigerator appliance may include a cabinet, a liner positioned within the cabinet defining a refrigerated chamber, and a variable shelf assembly mounted within the refrigerated chamber. The variable shelf assembly may include a stationary support screw extending along a movement axis, a mated screw, a shelving bracket, and a bi-directional ratchet gear. The mated screw may include an interior surface and an exterior surface. The interior surface may be rototranslatably mounted on the stationary support screw to rotate about the movement axis during translation therealong. The mated screw may be coaxial with the stationary support screw. The shelving bracket may be coupled to the mated screw. The shelving bracket may be rotationally fixed to translate along the movement axis. The bi-directional ratchet gear may be operably coupled to the mated screw to motivate rototranslation of the mated screw.

In another aspect of the present disclosure, a variable shelf assembly is provided. The variable shelf assembly may include a stationary support screw extending along a movement axis, a mated screw, a shelving bracket, and a bi-directional ratchet gear. The mated screw may include an interior surface and an exterior surface. The interior surface may be rototranslatably mounted on the stationary support screw to rotate about the movement axis during translation therealong. The mated screw may be coaxial with the stationary support screw. The shelving bracket may be coupled to the mated screw. The shelving bracket may be rotationally fixed to translate along the movement axis. The bi-directional ratchet gear may be operably coupled to the mated screw to motivate rototranslation of the mated screw.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
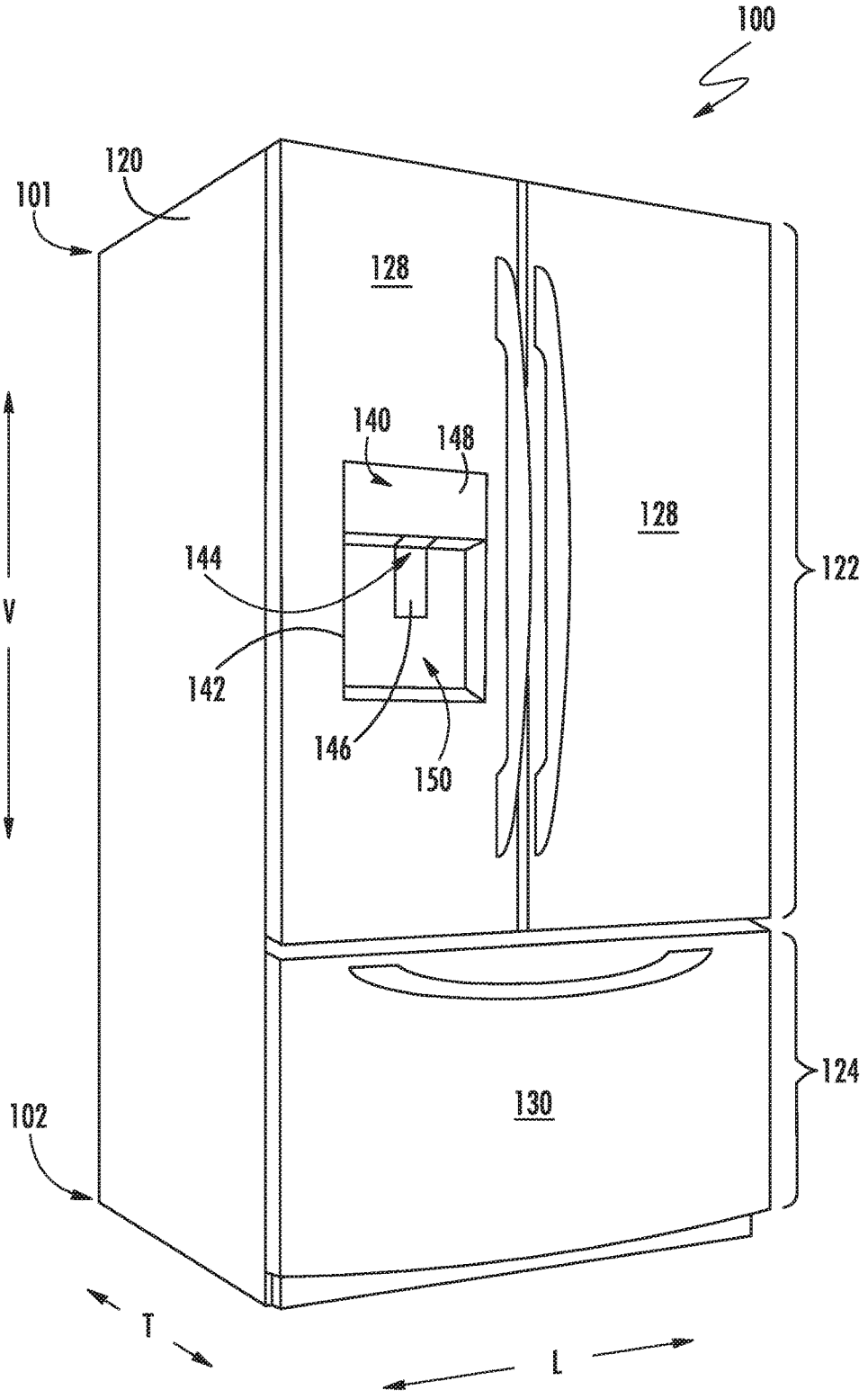
FIG. 1 provides a perspective view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure provides an appliance that has a variable shelf assembly. When assembled, the variable shelf assembly may be raised or lowered without being removed from the appliance. The variable shelf assembly may include a stationary support screw on which a mated screw may rotate. As the mated screw is rotated, the mated screw may raise or lower along the stationary support screw. A shelving bracket may be attached to the mated screw. As the mated screw moves vertically, the shelving bracket may move simultaneously.

Figure 2:
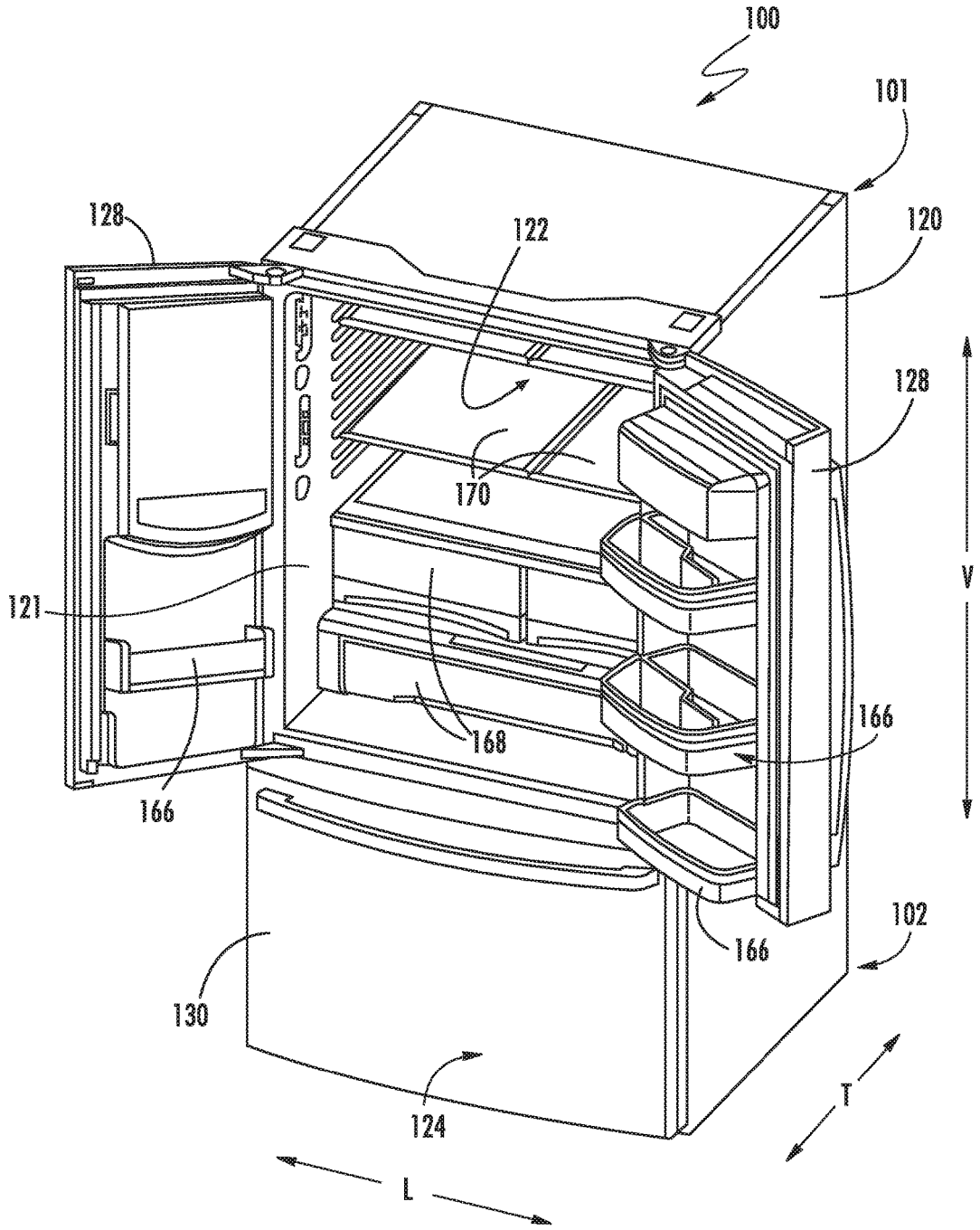
FIG. 2 provides a perspective view of the example refrigerator appliance of FIG. 1, wherein refrigerator doors of the refrigerator appliance are in an open position to reveal a fresh food chamber of the refrigerator appliance.
Figure 3:
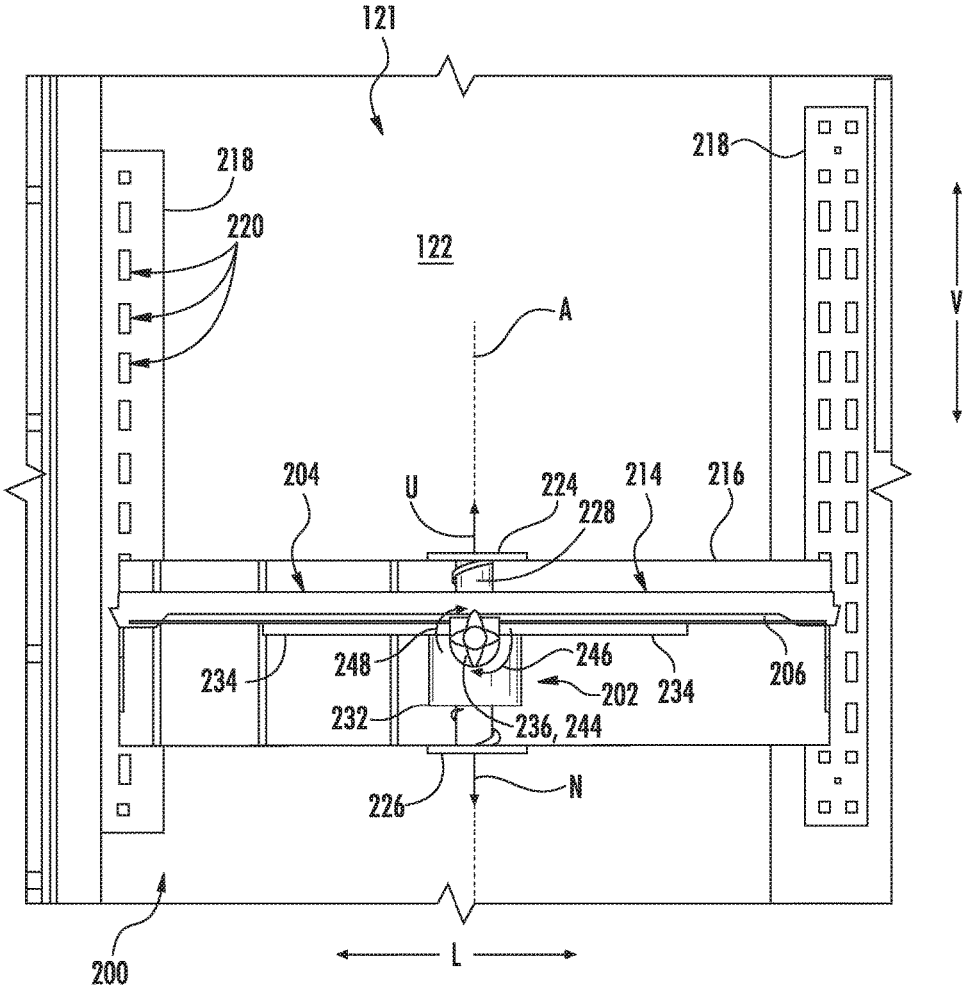
FIG. 3 provides a front view of a portion of the fresh food chamber of the example refrigerator appliance of FIG. 1, including a variable shelf assembly according to example embodiments of the present disclosure.
Figure 4:
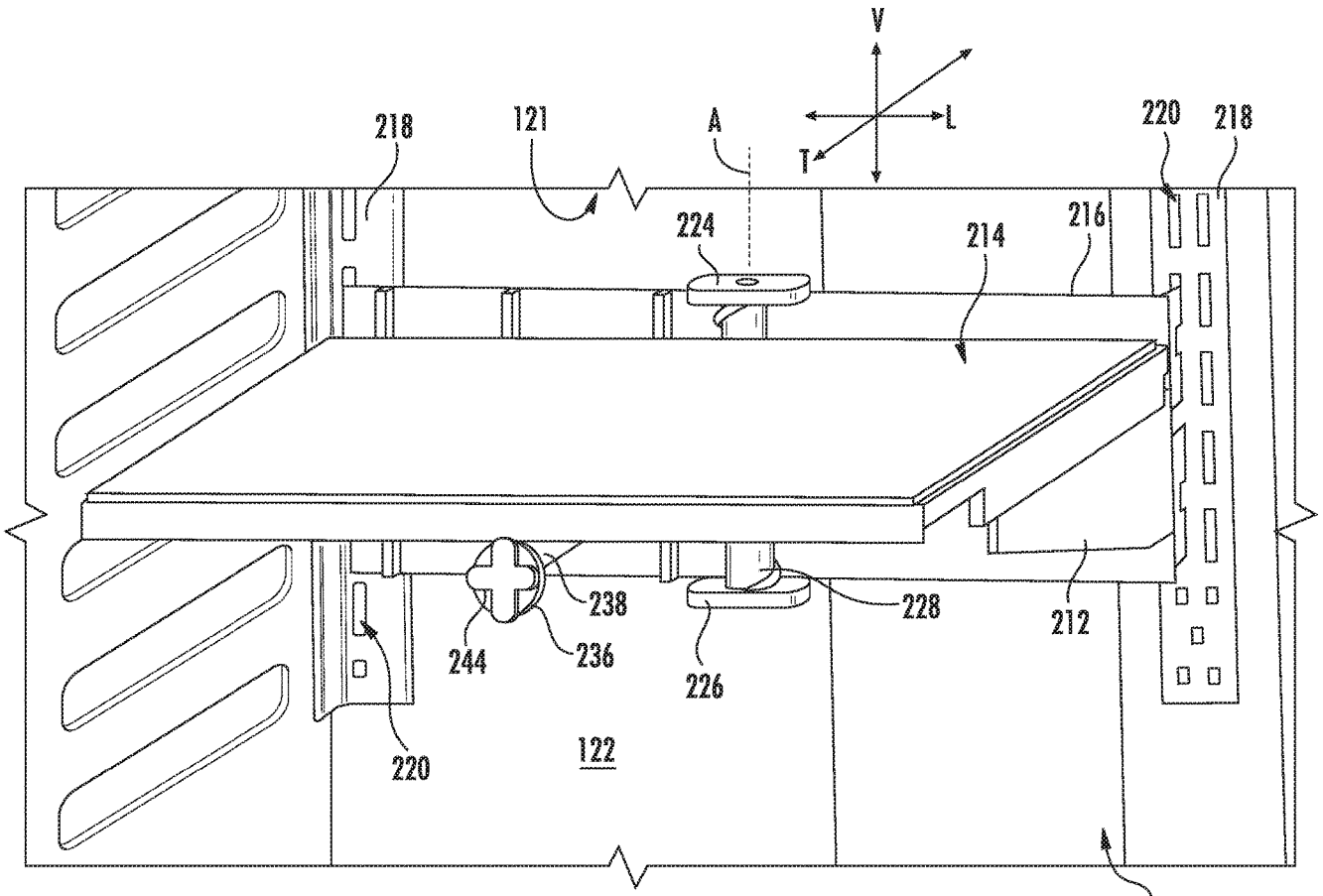
FIG. 4 provides a top perspective view of the example variable shelf assembly of FIG. 3.
Figure 5:
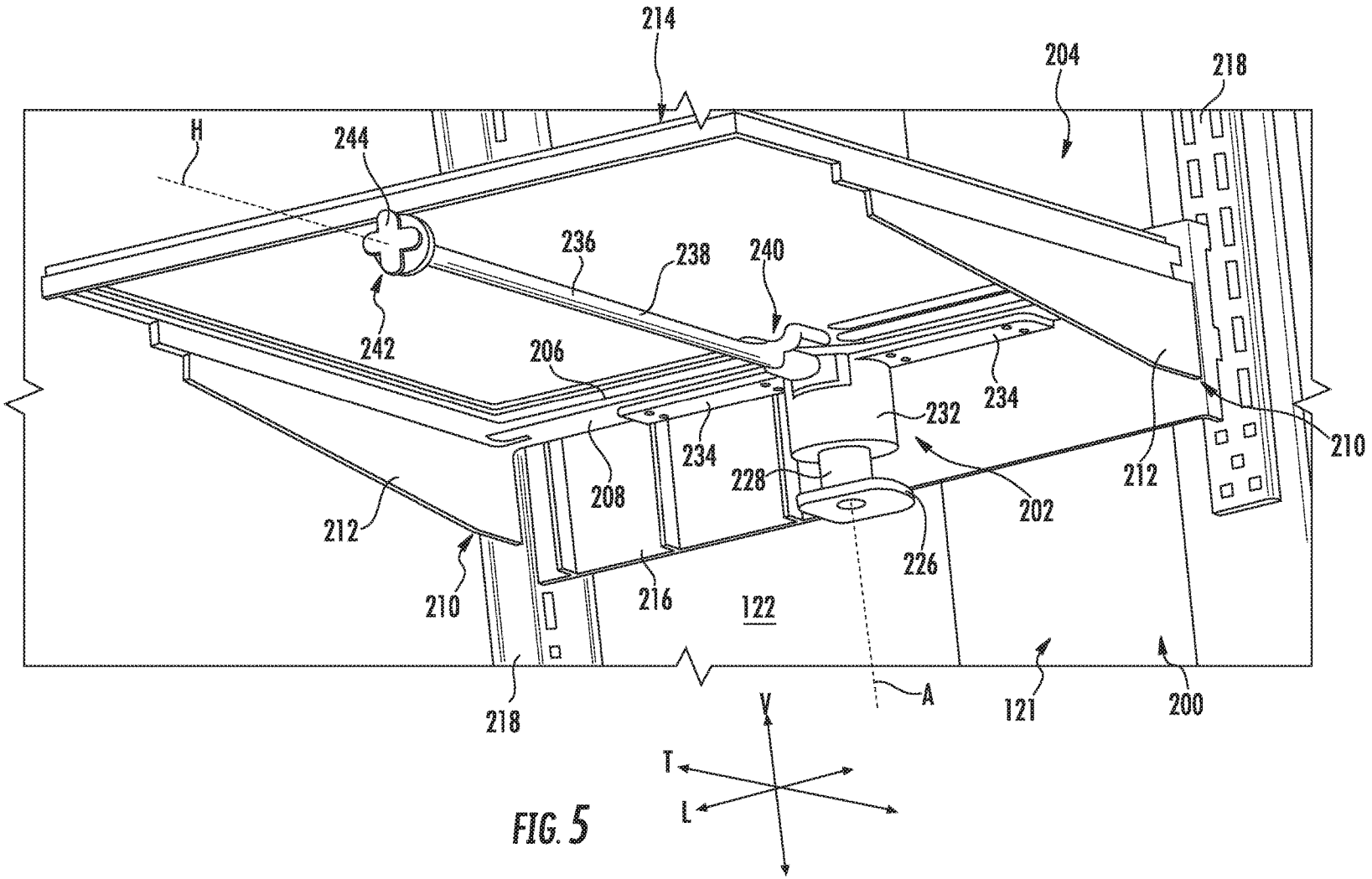
FIG. 5 provides a bottom perspective view of the example variable shelf assembly of FIG. 3.
Figure 6:
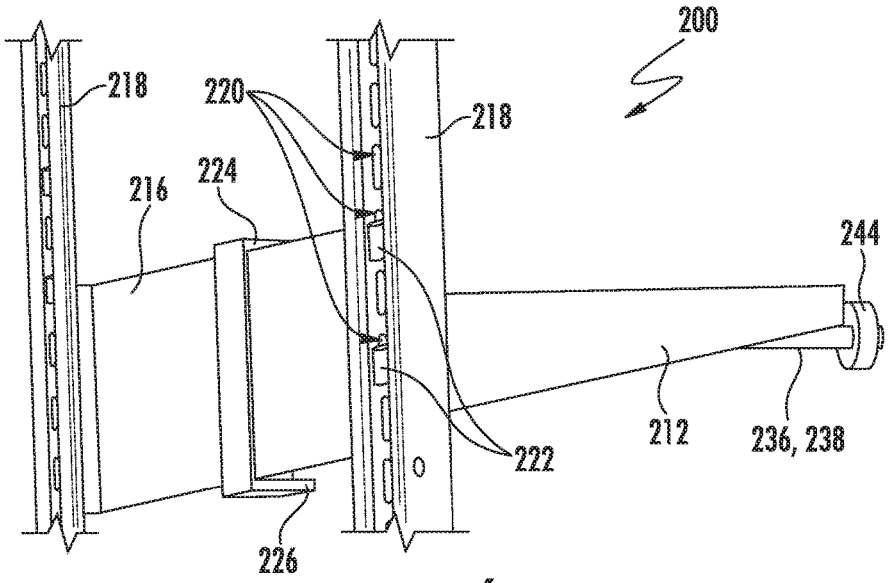
FIG. 6 provides a rear perspective view of the example variable shelf assembly of FIG. 3, wherein a liner wall has been removed for clarity.
Figure 7:
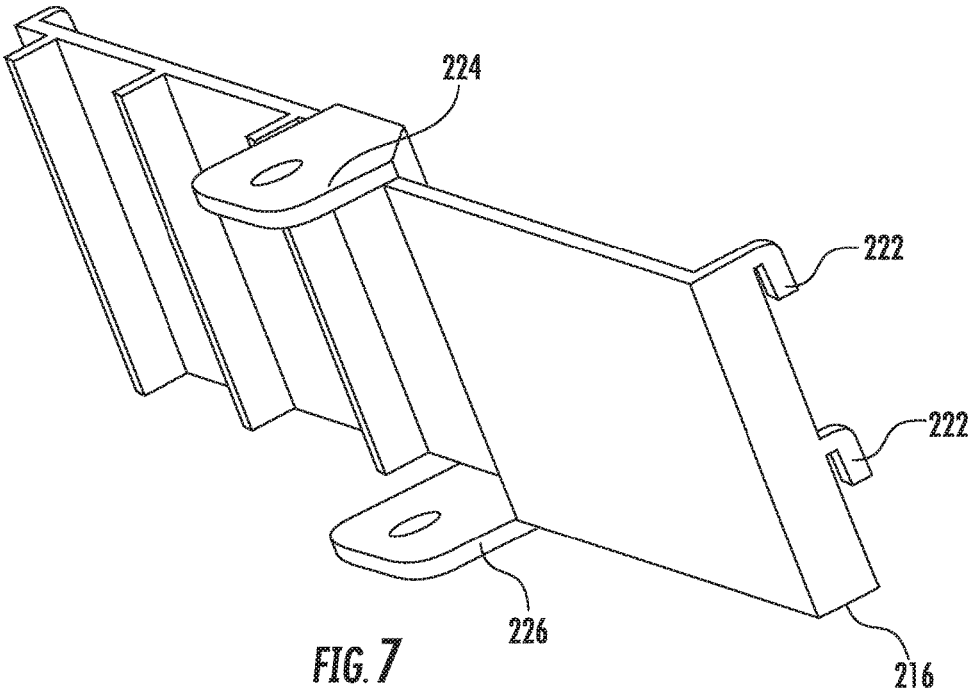
FIG. 7 provides a perspective view of a mounting plate of the example variable shelf assembly of FIG. 3.

Turning now to the figures, FIGS. 1 and 2, FIG. 1 provides a perspective view of a refrigerator appliance 100 according to an example embodiment of the present disclosure. FIG. 2 provides a perspective view of refrigerator appliance 100 having multiple refrigerator doors 128 in the open position. As shown, refrigerator appliance 100 includes a cabinet or cabinet 120 that extends between a top 101 and a bottom 102 along a vertical direction V. Cabinet 120 also extends along a lateral direction L and a transverse direction T, each of the vertical direction V, lateral direction L, and transverse direction T being mutually perpendicular to one another. In turn, vertical direction V, lateral direction L, and transverse direction T defines an orthogonal direction system.

Cabinet 120 includes a liner 121 that defines chilled chambers for receipt of food items for storage. In particular, liner 121 defines a fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure apply to other types and styles of appliances such as, e.g., a top mount refrigerator appliance, a side-by-side style refrigerator appliance, or a range appliance. Consequently, the description set forth herein is for illustrative purposes only and is not intended to be limiting in any aspect to any particular refrigerator chamber configuration.

Refrigerator doors 128 are rotatably hinged to an edge of cabinet 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

In some embodiments, refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of refrigerator doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128.

According to the illustrated embodiment, various storage components are mounted within fresh food chamber 122 to facilitate storage of food items therein as will be understood by those skilled in the art. In particular, the storage components include storage bins 166, drawers 168, and shelves 170 that are mounted within fresh food chamber 122. Storage bins 166, drawers 168, and shelves 170 are configured for receipt of food items (e.g., beverages and/or solid food items) and may assist with organizing such food items. As an example, drawers 168 can receive fresh food items (e.g., vegetables, fruits, and/or cheeses) and increase the useful life of such fresh food items.

Turning now to FIG. 3 through 6, a variable shelf assembly 200 is illustrated within fresh food chamber 122. Variable shelf assembly 200 is mounted to a portion of liner 121, e.g., at a back wall of liner 121. It is understood that variable shelf assembly 200 may include, or be provided as, one or more of shelves 170 (FIG. 2).

As shown, variable shelf assembly 200 includes a drive assembly 202 and a support assembly 204. Drive assembly 202 defines a movement axis A (e.g., at a stationary support screw 228) along which support assembly 204 may move. Specifically, drive assembly 202 may motivate or at least partially control movement of support assembly 204 along movement axis A, e.g., relative to liner 121. As will be described in detail below, drive assembly 202 may alternately translate support assembly 204 in an upward direction U and a downward direction N along movement axis A. Generally, upward direction U may extend above support assembly 204 while downward direction N extends below support assembly 204. When assembled, movement axis A may be parallel to the vertical direction V. Thus, drive assembly 202 may adjust the height of support assembly 204 within fresh food chamber 122.

In some embodiments, support assembly 204 includes a shelving bracket 206 attached to drive assembly 202. Shelving bracket 206 may include a brace 208 that extends, e.g., perpendicular to movement axis A. When assembled, brace 208 may generally extend in the lateral direction L between two end portions 210. One or more struts 212 may extend from brace 208, e.g., away from liner 121 and/or toward the cabinet opening selectively covered by doors 128 (see FIG. 2). As an example, a strut 212 may extend from brace 208 in the transverse direction T. In some such embodiments, a discrete strut 212 extends in the transverse direction T from each end portion 210 of brace 208.

In example embodiments, support assembly 204 includes a shelf or storage surface 214 attached to shelving bracket 206. When assembled, storage surface 214 is generally supported by shelving bracket 206. For instance, storage surface 214 may rest on top of shelving bracket 206 to move therewith, e.g., relative to movement axis A. Optionally, storage surface 214 may be fixed to shelving bracket 206 via one or more suitable adhesives, mechanical fasteners, or other attachment members. In example embodiments, storage surface 214 is a planar surface that extends orthogonal to movement axis A. In turn, storage surface 214 may include a flat plate formed from a suitable rigid material, such as tempered glass, plastic, or metal.

As shown in FIGS. 3 through 7, a mounting plate 216 is provided in some embodiments. Mounting plate 216 may be removably or selectively attached to cabinet 120, e.g., at liner 121. For instance, a retainer bar 218, e.g., a pair of retainer bars 218, may be fixed to liner 121. Retainer bar 218 may define one or more predetermined height indexes 220 to which mounting plate 216 mount. In some such embodiments, mounting plate 216 includes one or more index mounts 222, which selectively secure mounting plate 216 to a predetermined height index 220. As an example, predetermined height index 220 may be a receiving slot while index mount 222 is an n-shaped hook that may be selectively supported within the receiving slot. It is noted that although the height index-index mount pairs are shown, suitable alternative configurations may be provided within the scope of the present disclosure (e.g., wherein each height index 220 is a u-shaped hook and index mount 222 is a receiving slot).

Optionally, a plurality of height indexes 220 may be defined along retainer bar 218 such that an index mount 222 may be received at multiple discrete heights. In other words, mounting plate 216 may selectively attach higher or lower along a retainer bar 218, according to a user's desire. Moreover, multiple index mounts 222 may be provided. For instance, two or more index mounts 222 may be laterally spaced (i.e., spaced in the lateral direction L) on mounting plate 216 and correspond to two or more similarly spaced retainer bars 218.

In example embodiments, mounting plate 216 is generally configured to hold or restrain at least a portion of drive assembly 202. Optionally, mounting plate 216 may include a pair of vertically-spaced tabs 224, 226. An upper tab 224 may extend from mounting plate 216 at a top portion of mounting plate 216, e.g., in the transverse direction T away from liner 121. A lower tab 226 may extend from mounting plate 216 at a bottom portion of mounting plate 216, e.g., in the transverse direction T away from liner 121. As shown, upper tab 224 and lower tab 226 may be vertically aligned, e.g., such that tabs 224, 226 are in direct parallel alignment relative to the vertical direction V. Optionally, stationary support screw 228 may be mounted therebetween such that upper tab 224 and lower tab 226 are disposed at opposite ends along movement axis A.

Still referring now to FIGS. 3 through 6, drive assembly 202 includes a stationary support screw 228 that defines and/or extends along movement axis A. When assembled, stationary support screw 228 may be fixed relative to mounting plate 216, e.g., between upper tab 224 and lower tab 226. In turn, stationary support screw 228 may be prevented from moving (e.g., rotating and/or translating) with respect to mounting plate 216. Thus, stationary support screw 228 is generally fixed relative to liner 121 when mounted within fresh food chamber 122. As shown, stationary support screw 228 is provided as a generally cylindrical member. One or more threads 230 may extend about stationary support screw 228 along a helical path around movement axis A.

A sheath 232 is movably attached to stationary support screw 228. Specifically, sheath 232 is disposed about stationary support screw 228 to translate along movement axis A. In some embodiments, sheath 232 includes one or more attachment wings 234 that extend in a radially from movement axis A. Optionally, a pair of attachment wings 234 extends in the lateral direction L relative to movement axis A. At least a portion of support assembly 204 may be attached to sheath 232. In example embodiments, brace 208 of shelving bracket 206 is fixed (e.g., rotationally fixed) to sheath 232 at the pair of attachment wings 234. As sheath 232 is translated along movement axis A and stationary support screw 228, shelving bracket 206 is similarly translated (i.e., in non-rotating longitudinal translation). One or more suitable adhesives, mechanical fasteners, or other attachment members may secure shelving bracket 206 to attachment wings 234.

As shown, a handle 236 generally extends away from movement axis A. In some embodiments, handle 236 includes a shaft 238 that extends along the transverse direction T between a first end 240 proximate to stationary support screw 228 and a second end 242 distal to stationary support screw 228. For instance, handle 236, including shaft 238, may extend along the transverse direction T below storage surface 214. Moreover, second end 242 may extend to a front portion of planar surface 214, e.g., an easily-accessible front portion of support assembly 204. Optionally, handle 236 may rotate about shaft 238, e.g., about a handle rotation axis H defined by shaft 238. Sheath 232 may receive a pivot prong 286 of handle 236 at the first end 240, e.g., to guide rotation of handle 236. A rotational knob 244 may be fixed to the shaft 238 at the second end 242. Rotation of knob 244, e.g., by a user or separate motor (not pictured), at the second end 242 may thus rotate shaft 238 at the first end 240. For example, rotational knob 244 may be selectively rotated in a first handle direction 246 and an opposite second handle direction 248, as described below.

Turning now to FIGS. 8 through 16, generally, drive assembly 202 includes a mated screw 250 that is mounted on the stationary support screw 228. When assembled, mated screw 250 is disposed about movement axis A, coaxial with stationary support screw 228. For instance, mated screw 250 may be rotatably mounted within sheath 232.

As shown, mated screw 250 includes an interior surface 252 and an exterior surface 254. Interior surface 252 is generally directed towards movement axis A (e.g., radially inward relative to movement axis A) while exterior surface 254 is directed away from movement axis A (e.g., radially outward relative to movement axis A).

In some embodiments, mated screw 250 is rototranslatably mounted on the stationary support screw 228. Mated screw 250 may thus move along a generally helical path. In other words, mated screw 250 may rotate about movement axis A and stationary support screw 228 during or in conjunction with a longitudinal translation along movement axis A.

As shown, mated screw 250 is shaped to compliment stationary support screw 228. Specifically, interior surface 252 includes one or more grooves 256 that correspond in size and shape to the thread(s) 230 of stationary support screw 228. During use, interior surface 252 engages (e.g., directly contacts) a portion of an outer (e.g., radially outermost) surface of stationary support shaft 238. In turn, rotation of mated screw 250 about stationary support screw 228 will serve to translate mated screw 250 along stationary support screw 228 (i.e., longitudinally along movement axis A).

In some embodiments, mated screw 250 is rotatably mounted within sheath 232. Thus, sheath 232 may permit mated screw 250 to freely rotate therein, e.g., about movement axis A. Additionally, mated screw may be longitudinally fixed relative to sheath 232. Longitudinal translation of pivot lever mated screw 250 may thus be transferred directly to and mirrored by sheath 232, e.g., along movement axis A.

As shown in FIGS. 10 through 16, a plurality of gear teeth 258 are defined (e.g., in parallel to each other) along a portion of exterior surface 254 of mated screw 250. For example, gear teeth 258 may be defined on a circumferential band along exterior surface 254. In other words, discrete gear teeth 258 may be positioned at separate points along a circumferential path C defined about movement axis A. When assembled, gear teeth 258 may be disposed below at least a portion of support assembly 204, e.g., brace 208. As will be described below, gear teeth 258 may be engaged to motivate rotation of mated screw 250. During rotation of mated screw 250, engagement with stationary support screw 228 may motivate translation of mated screw 250.

A bi-directional ratchet gear 260 is included with some embodiments of drive assembly 202. Generally, bi-directional ratchet gear 260 is operably coupled to mated screw 250. In the example embodiments of FIGS. 8 through 13, bi-directional ratchet gear 260 is supported on sheath 232 proximate to mated screw 250. Additionally or alternatively, bi-directional ratchet gear 260 may have a semi-circular or elliptical cross-section profile, e.g., in a plane perpendicular to movement axis A. As shown, the semi-circular or elliptical cross-section profile includes plurality of ratchet teeth 262. Specifically, one or more (e.g., two) ratchet teeth 262 may be included on each of two opposing lobes 264, 266. Moreover, a gap 268 may be defined along the outer surface of bi-directional ratchet gear 260 between opposing lobes 264, 266.

When assembled, ratchet teeth 262 generally face mated screw 250. In some embodiments, ratchet teeth 262 are aligned with gear teeth 258 of mated screw 250 along movement axis A such that ratchet teeth 262 may selectively engage gear teeth 258. For instance, ratchet teeth 262 and gear teeth 258 may be positioned below brace 208. Bi-directional ratchet gear 260 may define a pivot axis P, e.g., parallel to movement axis A, about which bi-directional ratchet gear 260 may rotate in selective engagement with gear teeth 258 of mated screw 250.

Figure 11:
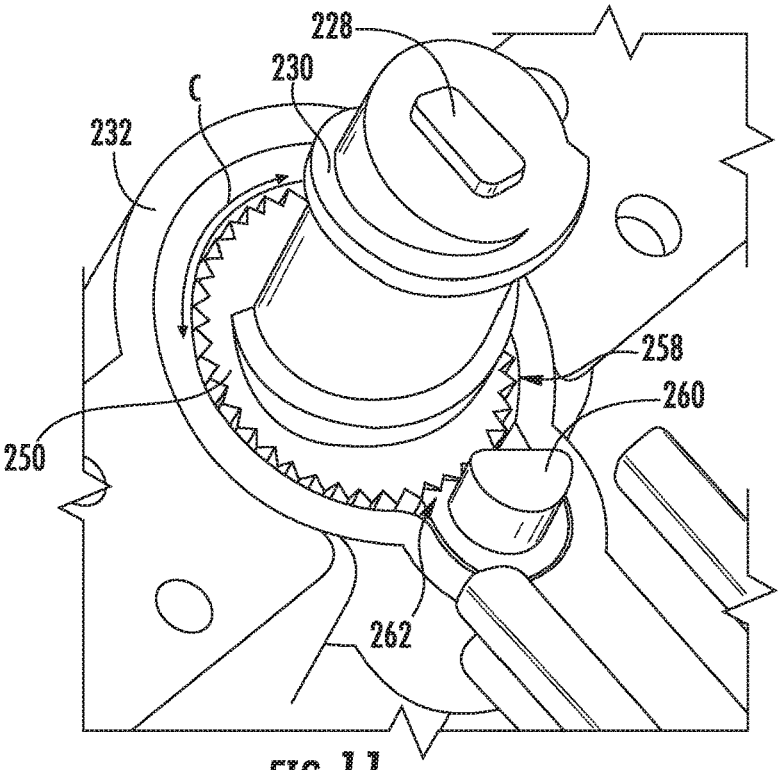
FIG. 11 is a magnified perspective view of a portion of the example variable shelf assembly of FIG. 3, wherein a lever of the drive assembly has been removed for clarity.
Figure 12:
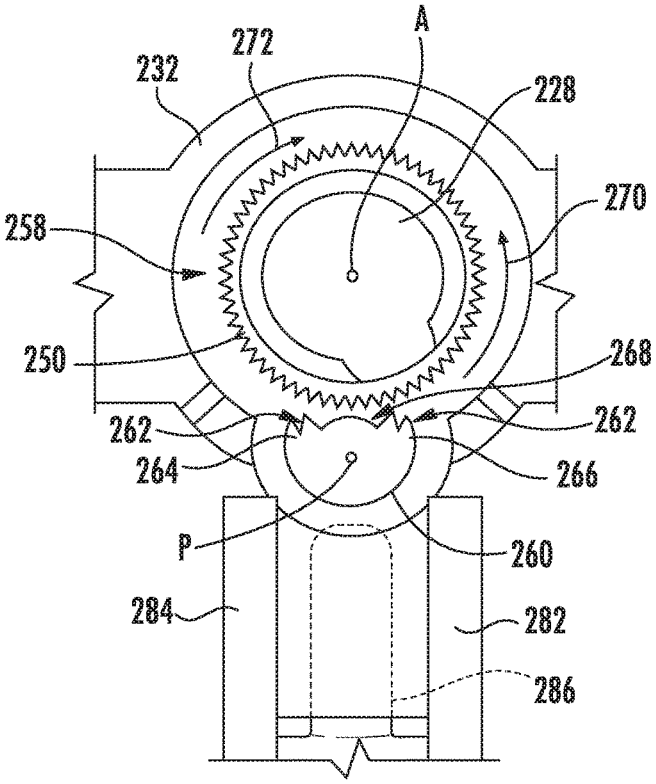
FIG. 12 is a magnified plan view of a portion of the example drive assembly of FIG. 11, wherein the drive assembly is in the neutral position of FIG. 8.
Figure 14:
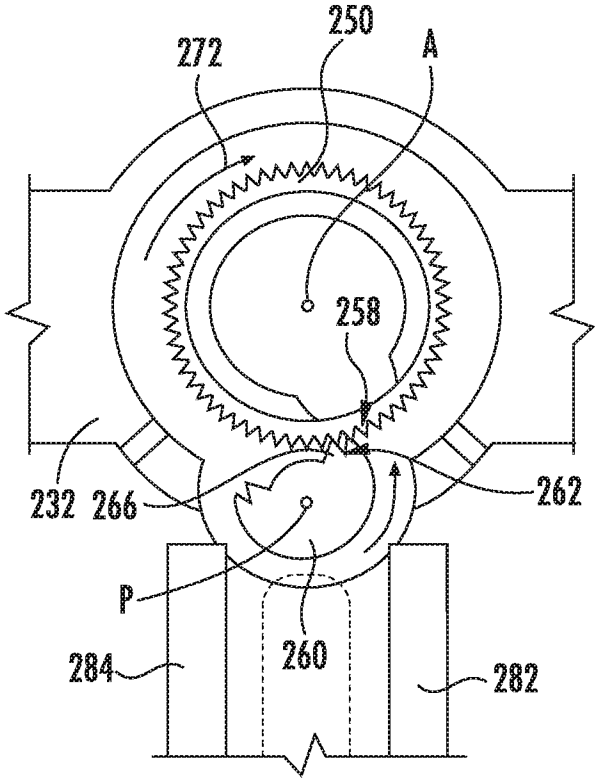
FIG. 14 is a magnified plan view of a portion of the example drive assembly of FIG. 11, wherein the drive assembly is in the second gear position of FIG. 10.
Figure 13:
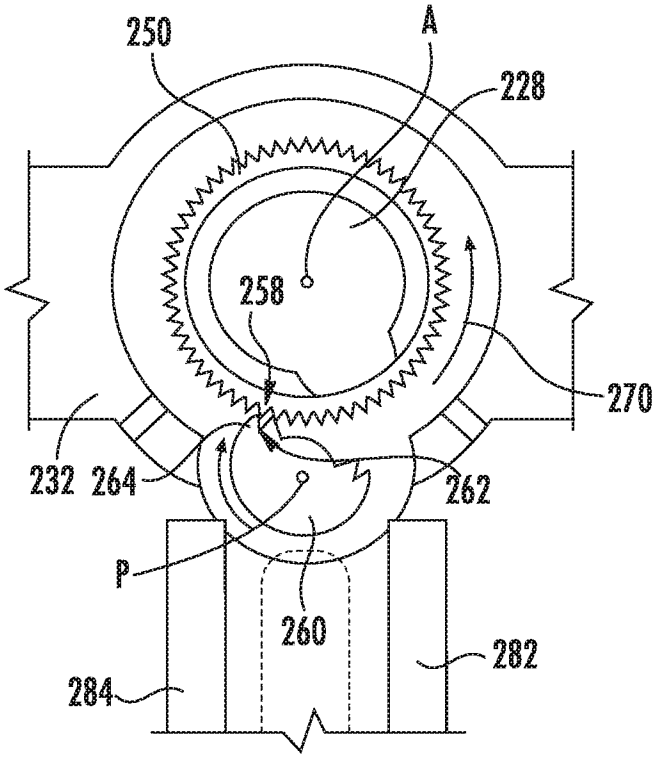
FIG. 13 is a magnified plan view of a portion of the example drive assembly of FIG. 11, wherein the drive assembly is in the first gear position of FIG. 9.
Figure 15:
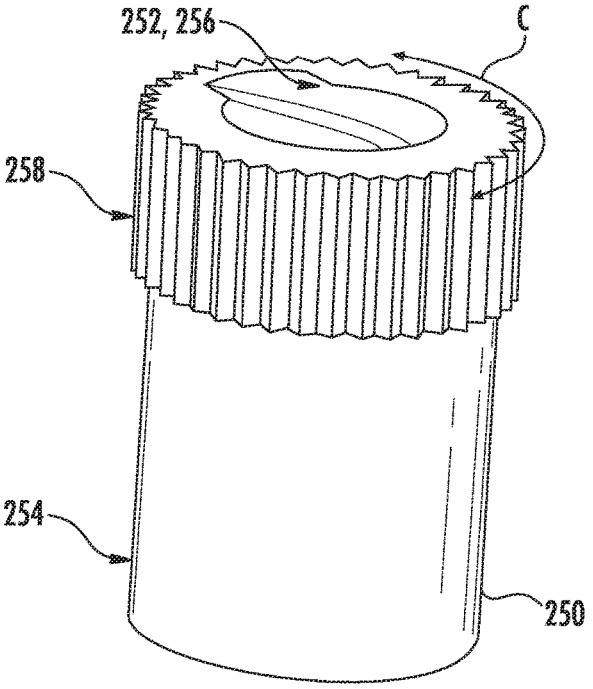
FIG. 15 is a perspective view of a mated screw of the example variable shelf assembly of FIG. 3.
Figure 16:
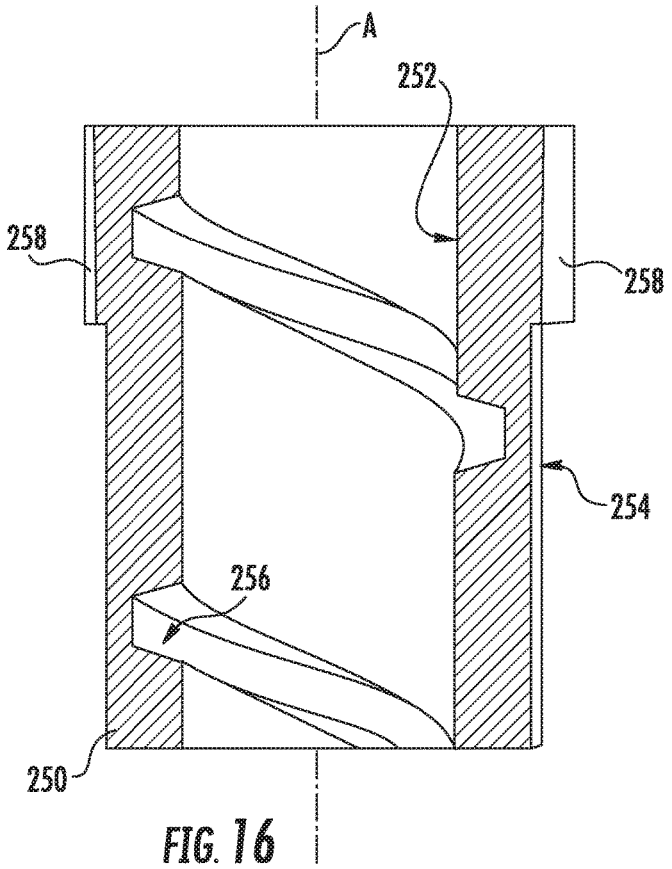
FIG. 16 is a cross-sectional view of the example mated screw of FIG. 15.

Turning specifically to FIGS. 11 through 13, ratchet teeth 262 of bi-directional ratchet gear 260 may selectively engage mated screw 250, e.g., to motivate rototranslation of mated screw 250. In some such embodiments, bi-directional ratchet gear 260 is pivotable between a first position (FIG. 13) and a second position (FIG. 14). A neutral third position (FIG. 12) may additionally be provided between the first and second positions.

As shown in FIG. 13, in the first position, ratchet teeth 262 formed on first lobe 264 engage a portion of the plurality of gear teeth 258 of mated screw 250. Engagement in the first position may serve to rotate mated screw 250 in a first direction 270, e.g., counter-clockwise about movement axis A. As described above, rotation of mated screw 250 in first direction 270 may cause mated screw 250 to translate along movement axis A, e.g., in the upward direction U. Moreover, upward translation of mated screw 250 will cause simultaneous upward translation of sheath 232 and/or support assembly 204. By contrast, and as shown in FIG. 14, in the second position, ratchet teeth 262 at a second lobe 266 engage a portion of the plurality of gear teeth 258 of mated screw 250. Engagement in the second position may serve to rotate mated screw 250 in second direction 272, e.g., clockwise about movement axis A. As described above, rotation of mated screw 250 in a second direction 272 may cause mated screw 250 to translate along movement axis A, e.g., in the downward direction N. Moreover, downward translation of mated screw 250 will cause simultaneous downward translation of sheath 232 and/or support assembly 204. Advantageously, the position (e.g., vertical position or height) of support assembly 204 may be varied within fresh food chamber 122 without requiring removal or disassembly of any portion of refrigerator appliance 100.

As shown in FIG. 12, a neutral position of bi-directional ratchet gear 260 may be provided, e.g., between the first and second positions. In the neutral position, neither lobe 264 or 266 engages mated screw 250. For instance, bi-directional ratchet gear 260 may be positioned such that gap 268 is proximate to or directly faces mated screw 250 and/or movement axis A. Opposing lobes 264, 266 may be held out of engagement or contact with gear teeth 258. During use, bi-directional ratchet gear 260 may be repeatedly rotated (i.e., ratcheted) between one of the first position or the second position and the neutral position. Thus, bi-directional may selectively advance the mated screw 250 in either the first direction 270 or the second direction 272 (and thereby upward or downward), as desired. Advantageously, mated screw 250 may be advanced through an incomplete or relatively small range of motion.

Returning now to FIGS. 8 through 10, a pivot lever 274 is included in some embodiments of drive assembly 202. For example, pivot lever 274 may be attached to sheath 232, e.g., at and/or about pivot axis P. In example embodiments, pivot lever 274 includes opposing first and second faces 276, 278. As shown, opposing first and second faces 276, 278 may be defined on an outer surface of pivot lever 274, e.g., as parallel to pivot axis P. From pivot axis P, pivot lever 274, including opposing first and second faces 276, 278, may extend in a direction away from mated screw 250, e.g., radially outward from mated screw 250. Specifically, pivot lever 274 may extend from a position above brace 208 and perpendicular to movement axis A.

During use, pivot lever 274 may direct or control movement of bi-directional ratchet gear 260. In some such embodiments, pivot lever 274 is fixed to bi-directional ratchet gear 260. Rotational movement of pivot lever 274, e.g., by a user or separate motor (not pictured), may thus be transferred directly to and mirrored by bi-directional ratchet gear 260. In turn, pivot lever 274 may pivot the bi-directional ratchet gear 260 between the first gear position (FIG. 9 and FIG. 13), the second gear position (FIG. 10 and FIG.

Figure 8:
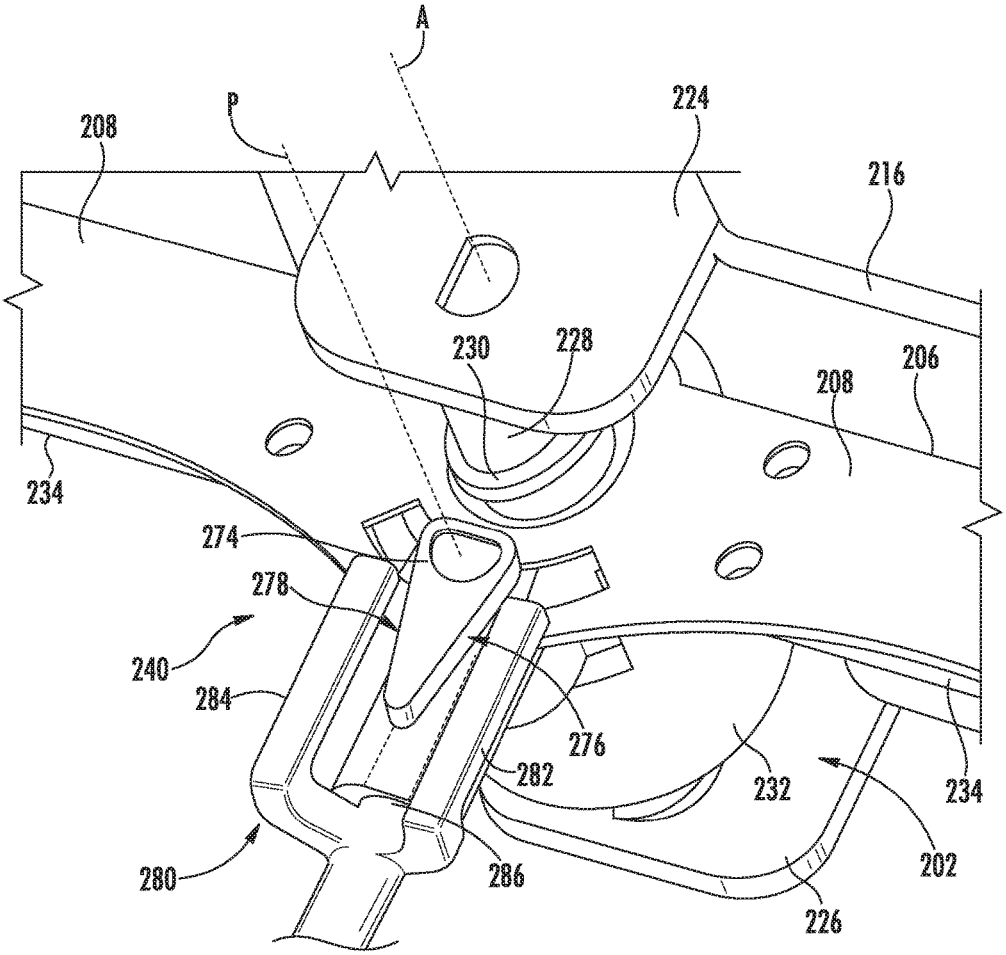
FIG. 8 is a magnified perspective view of a portion of the example variable shelf assembly of FIG. 3, including a drive assembly in a neutral position.

14), and the neutral position (FIG. 8 and FIG. 12). Optionally, a coupling prong may extend through brace 208 between bi-directional ratchet gear 260 and pivot lever 274 (e.g., along the pivot axis P) to fix bi-directional ratchet gear 260 to pivot lever 274.

Figure 9:
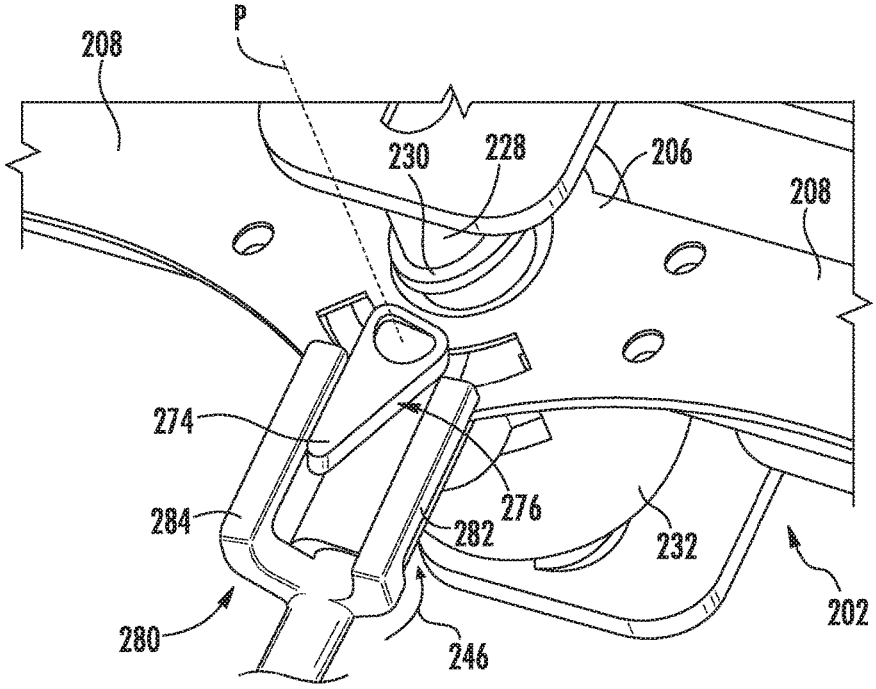
FIG. 9 is a magnified perspective view of a portion of the example variable shelf assembly of FIG. 3, including a drive assembly in a first gear position.
Figure 10:
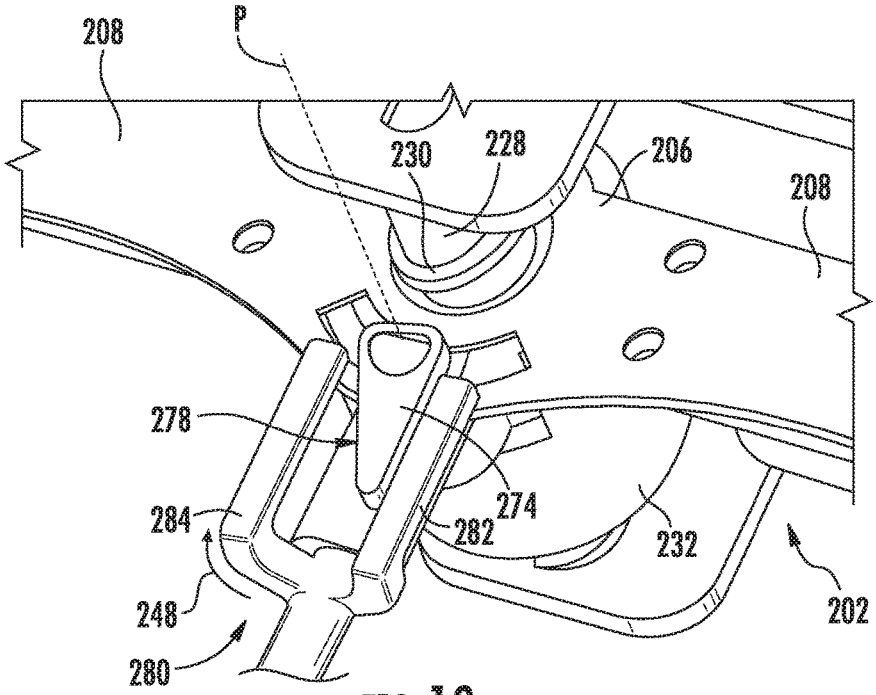
FIG. 10 is a magnified perspective view of a portion of the example variable shelf assembly of FIG. 3, including a drive assembly in a second gear position.

Referring still to FIGS. 8 through 10, example embodiments include handle 236 operably coupled to bi-directional ratchet gear 260, e.g., at the first end 240. For instance, in optional embodiments, handle 236 includes an articulating fork 280 to selectively direct or move the bi-directional ratchet gear 260. In some embodiments, articulating fork 280 includes a first prong 282 and a second prong 284 positioned above shelving bracket 206. A third (e.g., pivot) prong 286 may be rotatably mounted (e.g., to sheath 232) and define handle rotation axis H. Handle rotation axis H may be defined perpendicular to movement axis A. Optionally, third prong 286 may be coaxial with shaft 238. Additionally or alternatively, third prong 286 may be positioned below shelving bracket 206. During use, shelving bracket 206 may constrain or restrict rotation of first and second prongs 282, 284, e.g., such that articulating fork 280 may be prevented from full 360° rotation about handle rotation axis H.

In some embodiments, first and second prongs 282, 284 may be positioned at opposite sides of pivot lever 274. For instance, first prong 282 may be proximate first face 276 of pivot lever 274 while second prong 284 is proximate second face 276, 278 of pivot lever 274. During use, handle 236 may rotate to engage pivot lever 274. Specifically, first prong 282 may selectively contact first face 276 of pivot lever 274, and second prong 284 may selectively contact second face 276, 278 of pivot lever 274. As example, when pivot lever 274 is in the second position, handle 236 may be rotated about handle rotation axis H, bringing first prong 282 into engagement or contact with first face 276 of pivot lever 274. Upon first prong 282 engaging or contacting first face 276 of pivot lever 274, pivot lever 274 may be motivated about pivot axis P. Handle 236 may continue to rotate about handle rotation axis H until pivot lever 274 is brought to the neutral position and/or first position. From the first position or the neutral position, handle 236 movement may be reversed (i.e., rotated in the opposite direction about handle rotation axis H), and second prong 284 may motivate pivot lever 274 to the neutral position and/or second position, as desired.

As described above, rotation of pivot lever 274 may cause rotation of bi-directional ratchet gear 260, and thus, longitudinal translation of mated gear 250 and shelving bracket 206 along movement axis A. Moreover, as further described above, rotational knob 244 may control the rotational position or movement of handle 236. For instance, rotation knob 244 and be rotatable in a first handle direction 246 and a second handle direction 248. Thus, in some embodiments, rotation of rotational knob 244 in the first handle direction 246 initiates sliding translation of shelving bracket 206 in one of the upward direction U or the downward direction N. Rotation of the rotational knob 244 in the second handle direction 248 initiates translation of shelving bracket 206 in the other of the upward direction U or the downward direction N.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet;

a liner positioned within the cabinet defining a refrigerated chamber; and a variable shelf assembly mounted within the refrigerated chamber, the variable shelf assembly comprising a stationary support screw extending along a movement axis, a mated screw comprising an interior surface and an exterior surface, the interior surface being rototranslatably mounted on the stationary support screw to rotate about the movement axis during translation therealong, the mated screw being coaxial with the stationary support screw, a shelving bracket coupled to the mated screw, the shelving bracket being rotationally fixed to translate along the movement axis, and a bi-directional ratchet gear operably coupled to the mated screw to motivate rototranslation of the mated screw, wherein the bi-directional ratchet gear comprises a plurality of ratchet teeth in selective engagement with the mated screw, and wherein the bi-directional ratchet gear further comprises a pair of opposing lobes supporting the plurality of ratchet teeth on opposite sides of a pivot axis of the bi-directional ratchet gear.

2. The refrigerator appliance of claim 1, wherein the cabinet defines a transverse direction orthogonal to the movement axis, and wherein the variable shelf assembly further comprises a handle including a shaft extending within the refrigerated chamber along the transverse direction between a first end and a second end, the handle being operably coupled to the bi-directional ratchet gear at the first end.

3. The refrigerator appliance of claim 2, wherein the handle includes a rotational knob fixed to the shaft at the second end, wherein the rotational knob is rotatable in a first handle direction and a second handle direction opposite the first handle direction, wherein the first handle direction initiates translation of the shelving bracket in one of an upward direction or a downward direction, and wherein the second handle direction initiates translation of the shelving bracket in the other of the upward direction or the downward direction.

4. The refrigerator appliance of claim 3, further comprising a planar storage surface fixed to the shelving bracket, wherein the rotational knob is slidably positioned at a front portion of the planar storage surface to control a vertical position thereof.

5. The refrigerator appliance of claim 1, wherein the variable shelf assembly further comprises a pivot lever fixed to the bi-directional ratchet gear to pivot the bi-directional ratchet gear between a first gear position and a second gear position, wherein the pivot lever extends away from the mated screw within the refrigerated chamber.

6. The refrigerator appliance of claim 5, wherein the pivot lever includes an opposing first face and second face, wherein the variable shelf assembly further comprises an articulating fork to selectively engage the pivot lever, the articulating fork comprising a first prong proximate the first face and a second prong proximate the second face.

7. The refrigerator appliance of claim 5, wherein the shelving bracket includes a brace extending below the pivot lever perpendicular to the movement axis.

8. The refrigerator appliance of claim 5, wherein the variable shelf assembly further comprises an articulating fork positioned above the shelving bracket, the articulating fork comprising a first prong and a second prong, and wherein the shelving bracket selectively restricts rotation of the articulating fork at the first prong and the second prong.

9. The refrigerator appliance of claim 1, further comprising a retainer bar fixed to the liner, the retainer bar defining a predetermined height index, and wherein the stationary support screw is selectively mounted to the retainer bar at the predetermined height index.

10. A variable shelf assembly comprising:

a stationary support screw extending along a movement axis;

a mated screw comprising an interior surface and an exterior surface, the interior surface being rototranslatably mounted on the stationary support screw to rotate about the movement axis during translation therealong, the mated screw being coaxial with the stationary support screw;

a shelving bracket coupled to the mated screw, the shelving bracket being rotationally fixed to translate along the movement axis; and a bi-directional ratchet gear operably coupled to the mated screw to motivate rototranslation of the mated screw, wherein the bi-directional ratchet gear comprises a plurality of ratchet teeth in selective engagement with the mated screw, and wherein the bi-directional ratchet gear further comprises a pair of opposing lobes supporting the plurality of ratchet teeth on opposite sides of a pivot axis of the bi-directional ratchet gear.

11. The variable shelf assembly of claim 10, wherein the variable shelf assembly defines a transverse direction orthogonal to the movement axis, and wherein the variable shelf assembly further comprises a handle including a shaft extending along the transverse direction between a first end and a second end, the handle being operably coupled to the bi-directional ratchet gear at the first end.

12. The variable shelf assembly of claim 11, wherein the handle includes a rotational knob fixed to the shaft at the second end, wherein the rotational knob is rotatable in a first handle direction and a second handle direction opposite the first handle direction, wherein the first handle direction initiates translation of the shelving bracket in one of an upward direction or a downward direction, and wherein the second handle direction initiates translation of the shelving bracket in the other of the upward direction or the downward direction.

13. The variable shelf assembly of claim 12, further comprising a planar storage surface fixed to the shelving bracket, wherein the rotational knob is slidably positioned at a front portion of the planar storage surface to control a vertical position thereof.

14. The variable shelf assembly of claim 10, further comprising a pivot lever fixed to the bi-directional ratchet gear to pivot the bi-directional ratchet gear between a first gear position and a second gear position, wherein the pivot lever extends away from the mated screw.

15. The variable shelf assembly of claim 14, wherein the pivot lever includes an opposing first face and second face, wherein the variable shelf assembly further comprises an articulating fork to selectively engage the pivot lever, the articulating fork comprising a first prong proximate the first face and a second prong proximate the second face.

16. The variable shelf assembly of claim 14, wherein the shelving bracket includes a brace extending below the pivot lever perpendicular to the movement axis.

17. The variable shelf assembly of claim 14, further comprising an articulating fork positioned above the shelving bracket, the articulating fork comprising a first prong and a second prong, and wherein the shelving bracket selectively restricts rotation of the articulating fork at the first prong and the second prong.

18. The variable shelf assembly of claim 10, further comprising a retainer bar defining a predetermined height index, and wherein the stationary support screw is selectively mounted to the retainer bar at the predetermined height index.

19. A variable shelf assembly comprising:

a stationary support screw extending along a movement axis;

a mated screw comprising an interior surface and an exterior surface; the interior surface being rototranslatably mounted on the stationary support screw to rotate about the movement axis during translation therealong, the mated screw being coaxial with the stationary support screw;

a shelving bracket coupled to the mated screw, the shelving bracket being rotationally fixed to translate along the movement axis;

a bi-directional ratchet gear operably coupled to the mated screw to motivate rototranslation of the mated screw; and a pivot lever fixed to the bi-directional ratchet gear to pivot the bi-directional ratchet gear between a first gear position and a second gear position;

wherein the pivot lever extends away from the mated screw, wherein the pivot lever includes an opposing first face and second face, and wherein the variable shelf assembly further comprises an articulating fork to selectively engage the pivot lever, the articulating fork comprising a first prong proximate the first face and a second prong proximate the second face.

20. The variable shelf assembly of claim 19, wherein the shelving bracket comprises a brace extending below the pivot lever perpendicular to the movement axis, and wherein the shelving bracket selectively restricts rotation of the articulating fork at the first prong and the second prong.

* * * * *